US006702409B2

(12) United States Patent
Hedrick et al.

(10) Patent No.: US 6,702,409 B2
(45) Date of Patent: Mar. 9, 2004

(54) GAMING DEVICE HAVING A DOOR WITH A MOVEABLE AND/OR A REMOVABLE BOLSTER

(75) Inventors: Joseph R. Hedrick, Reno, NV (US); Jean P. Legras, Reno, NV (US); Kehl T. LeSourd, Reno, NV (US); Kirk A. Tedsen, Reno, NV (US)

(73) Assignee: IGT, Reno, NV (US)

( * ) Notice: Subject to any disclaimer, the term of this patent is extended or adjusted under 35 U.S.C. 154(b) by 108 days.

(21) Appl. No.: 09/964,001

(22) Filed: Sep. 26, 2001

(65) Prior Publication Data

US 2002/0041133 A1 Apr. 11, 2002

Related U.S. Application Data

(60) Provisional application No. 60/239,376, filed on Oct. 11, 2000.

(51) Int. Cl.[7] ..... B68G 5/00

(52) U.S. Cl. ..... 312/223.1

(58) Field of Search ..... 312/223.1, 321.5, 312/300, 281, 7.2; 248/118, 118.3; 463/13, 46, 16, 34, 35, 36, 47; 273/143 R, 138 A, 138 R, 142 R

(56) References Cited

U.S. PATENT DOCUMENTS 4,795,155 A * 1/1989 Grande ..... 273/143 R
D344,296 S * 2/1994 McKay et al. ..... D21/326
5,316,373 A * 5/1994 Markel ..... 297/411.32
5,711,503 A * 1/1998 Mitchell, Sr. ..... 248/311.2
6,161,805 A 12/2000 Wells
6,201,532 B1 * 3/2001 Tode et al. ..... 345/156
D450,353 S * 11/2001 LeSourd et al. ..... D21/385
6,422,670 B1 * 7/2002 Hedrick et al. ..... 312/223.1

OTHER PUBLICATIONS

Comfort Gaming House written by www.comfortgaming-.com (website) printed Apr. 23, 2001.
Comfort Gaming House Written by www.comfortgaming-.com (website) printed Jan. 16, 2002.

* cited by examiner

*Primary Examiner*—Janet M. Wilkens
(74) *Attorney, Agent, or Firm*—Bell, Boyd & Lloyd LLC

(57) ABSTRACT

The present invention provides a gaming device and more specifically a front door of a gaming device that has a moveable and/or removable bolster that swings out of the way, so that an operator may open the door without the bolster hitting the bolster of an adjacent gaming device. The front door is pivotally connected to the gaming device using one or more hinges and facilitates access to the interior of the gaming machine. The moveable and/or removable bolster pivotally attaches to the door. In one preferred embodiment, when unlocked, the bolster automatically swings open to a preliminary angle, whereby the operator lifts the bolster to the predefined operating angle. In one alternative embodiment, when unlocked, the bolster automatically swings open to the predefined operating angle.

51 Claims, 10 Drawing Sheets

GAMING DEVICE HAVING A DOOR WITH A MOVEABLE AND/OR A REMOVABLE BOLSTER

PRIORITY CLAIM

This application claims the benefit of U.S. Provisional Patent Application No. 60/239,376, filed Oct. 11, 2000, the entire contents of which are hereby incorporated by reference and relied upon.

CROSS-REFERENCE TO RELATED APPLICATIONS

This application is related to the following commonly-owned co-pending design patent applications: "Player Interface and Tray for a Gaming Device," Ser. No. 29/130,983, now patent No. D450,094; and "Player Interface With Bolster for a Gaming Device," Ser. No. 29/130,980, now patent No. D451,153.

DESCRIPTION

The present invention relates in general to a gaming device, and more particularly to a gaming device having a cabinet with a door with a moveable and/or a removable bolster.

BACKGROUND OF THE INVENTION

Space in gaming areas on a casino floor or otherwise is at a premium. To maximize gaming activity, gaming device owners desire to place as many gaming machines or devices as possible in the gaming area and provide as small a space as possible between adjacent machines. Maintenance people and operators, however, must gain access to the interior of the device from time to time. Gaming devices require routine maintenance and servicing. Operators must intermittently load, unload and service the gaming device hoppers. Gaming devices consequently include a cabinet having a front door which provides access to the gaming device.

Older gaming devices were generally equipped with flat front cabinets. An operator could access the gaming device interior through a front door hinged to the cabinet, which opened without hitting or interfering with any adjacent device. The older machines enabled casinos to place the gaming devices in close proximity to each other, approximately six inches (or less) apart.

More recently, however, gaming devices have been ergonomically designed with player interfaces and bolsters that protrude from the front door of the gaming device cabinet. The bolsters enable the player to rest their arms and partial body weight on the machine to achieve a more comfortable temporary or semi-permanent position. For example, U.S. Pat. No. 6,161,805, which issued on Dec. 19, 2000, discloses an ergonomic hand rest for gaming machines.

While these interfaces and bolsters are more comfortable and appealing to players, they take up more space in the gaming area. As illustrated in FIG. 3, accessing the interior of the ergonomic gaming devices 10 still requires opening a front door 49 of a cabinet 11. The bolster 50 extending from the opened door 49 will interfere with or engage the adjacent gaming device 10 when an operator opens the door 49. This interference limits or prohibits play on the adjacent device 10 and limits the opening of the door 49, which in turn inhibits access to the interior of the gaming device 10 and impedes service of the gaming device.

One solution is to remove the gaming device from the gaming area for service. This is prohibitively expensive and disruptive to the patrons. Another solution is to provide access to the interior through the back of the gaming device. This requires that the gaming device be pulled away from any surrounding devices to permit access to the interior. Yet another solution is to laterally space the gaming devices farther apart. This is not a preferred solution from the point of view of the gaming device owners. A further solution is to return to less ergonomic designs (i.e., gaming devices with generally flat fronts). However, such less ergonomic designs are not attractive to the patrons and therefore generally receive less play. Another solution is proposed in U.S. Pat. No. 6,161,805. This provides a hand rest with opposing support arms which are adapted to rotate above the gaming device. This design is impractical for upright gaming devices and for gaming devices having toppers. This design also adds substantial costs to the manufacture of gaming devices.

Accordingly, a need exists to provide a gaming device with front door access and an ergonomic bolster that can be accessed without interfering with adjacent machines. The front door should allow an operator to have full access to the gaming device.

SUMMARY OF THE INVENTION

The present invention overcomes the above shortcomings by providing a front face or front door of a gaming device with a positionally adjustable bolster. The bolster may be described alternatively herein as "adjustable," "positionally adjustable," "moveable" and "removable." For brevity, the bolster is referred to herein as "moveable" or "adjustable." However, the scope of the present invention is not intended to be limited by the use of such term or any other abbreviated terms used herein to describe the present invention, components, steps or processes thereof. The present invention generally provides a gaming device having a cabinet with a front door with a moveable or removable bolster. The front door is preferably pivotally connected to the gaming device using hinges and facilitates access to the interior of the gaming machine.

The bolster is moveably or removably connected to the front door of the gaming device using a moveable or releasable mechanism. In one embodiment, the bolster moves relative to the front door by a rotating or sliding mechanism. In another embodiment, the bolster is removed from the front cabinet using a releasable locking mechanism.

More specifically, one embodiment of the present invention provides a gaming device having a front door that has a moveable and/or removable bolster that rotates, moves or swings out of the way, so that an operator may open the door without the bolster hitting the bolster of an adjacent gaming device. The front door is pivotally connected to the gaming device using one or more hinges and facilitates access to the interior of the gaming machine. The moveable bolster pivotally attaches to the door. The present invention includes alternative pivoting device embodiments. In one preferred embodiment, when unlocked, the bolster automatically swings open to a preliminary angle, whereby the operator lifts the bolster to the predefined operating angle. In one alternative embodiment, when unlocked, the bolster automatically swings open to the predefined operating angle.

In one embodiment, the door of the present invention may be partially opened without moving the attached ergonomic bolster. The operator opens the door partially and pulls a release knob that unlocks the bolster. In both pivoting device embodiments, the bolster automatically springs open at least to a preliminary angle so that the door does not automatically re-lock when the operator releases the release knob. The preferred pivoting device embodiment includes a compression spring that pivots the bolster through a small angle, for example, five degrees. The operator then manually pivots the bolster the rest of the way to the operating position, for example, to an angle of twenty to ninety degrees and in one embodiment to about thirty-five degrees. When the bolster reaches the operating position, the bolster locks into place as described in detail below.

One alternative pivoting device embodiment includes a torsion spring that automatically pivots the bolster to the operating angle. The alternative pivoting device includes a hard stop at the predefined operating angle, e.g., at about thirty-five degrees. In either pivoting device embodiment, once the ergonomic bolster reaches the operating angle, the operator may fully open the front door and have access to the interior of the gaming device. It should also be appreciated that the bolster in either pivoting device embodiment may also be adapted to be removable.

It is therefore an advantage of the present invention to provide a gaming device having a front door with a moveable and/or removable bolster.

It is another advantage of the present invention to provide a gaming device having an ergonomic bolster that does not interfere or engage adjacent gaming devices.

It is another advantage of the present invention to provide a gaming device having a hinged front door with a rotatable bolster.

It is yet a further advantage of the present invention to provide a gaming device having a hinged front door with a removable and/or moveable bolster that enables the operator or maintenance person to have full access to the machine.

It is still a further advantage of the present invention to provide a bolster that is easy to move.

Still further, another advantage of the present invention is to provide a movable bolster that remains in an operating position whether the main door of the gaming device is open or closed.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1:
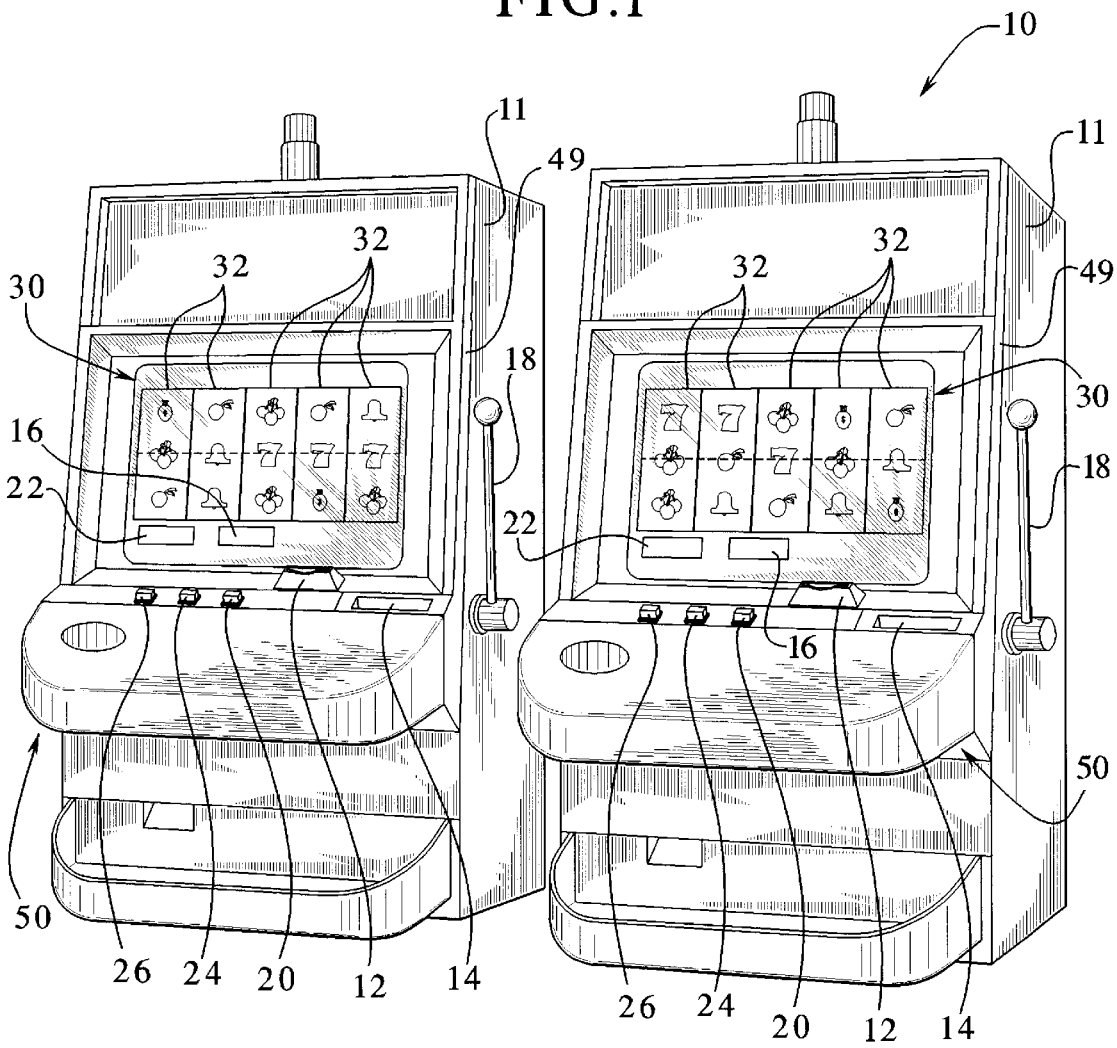
FIG. 1 is a front perspective view of one embodiment of adjacent gaming devices of the present invention.
Figure 4:
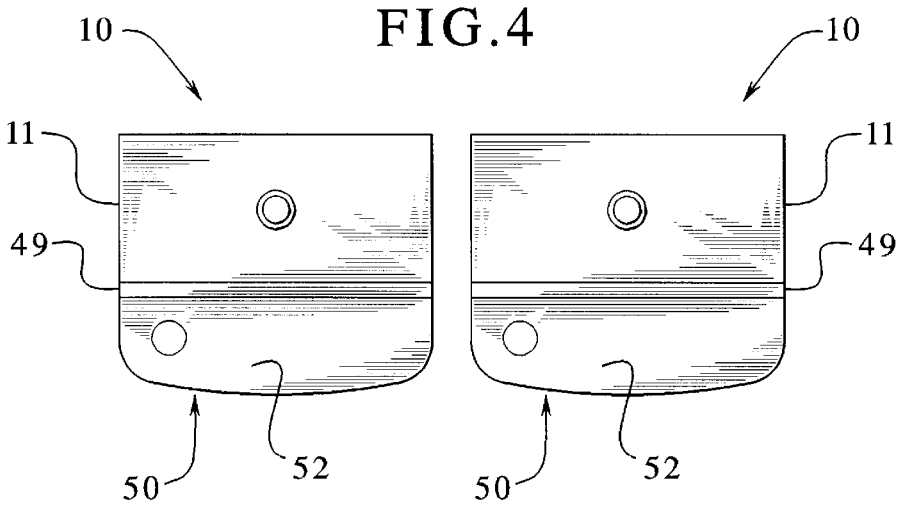
FIG. 4 is a top plan view of the gaming devices of FIG. 1.
Figure 2:
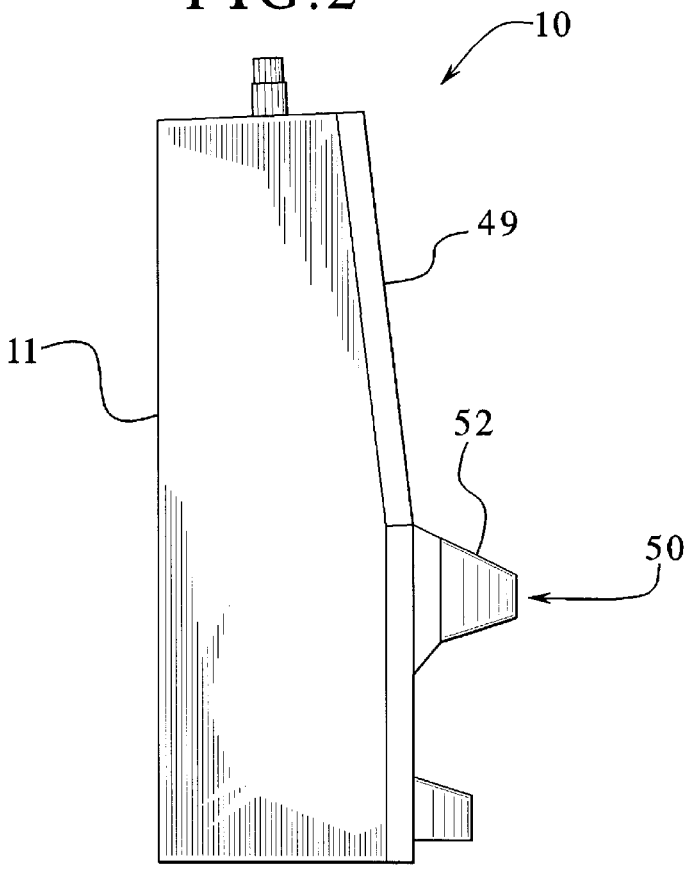
FIG. 2 is a side elevation view of a gaming device of the present invention.

Referring now to the drawings, two gaming devices 10 of one preferred gaming machine embodiment of the present invention include the controls, displays and features of a conventional gaming machine as illustrated in FIG. 1. Each gaming device 10 includes a cabinet 11 having an access door 49 pivotally connected to the cabinet 11. The gaming device 10 is constructed so that a player can operate it while standing or sitting.

The gaming device 10 includes a coin slot 12 and bill acceptor 14 where the player inserts money, coins or tokens. The player can place coins in the coin slot 12 or paper money in the bill acceptor 14. Gaming device 10 may be adapted to use other known devices (not illustrated) for accepting payment, such as readers or validators for accepting credit cards, debit cards or tickets having an amount of money imprinted in a barcode. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism, such as an area of a touch screen, which starts the game.

The gaming device 10 also includes a bet display 22 and a bet one button 24. The player places a bet by pushing the bet one button 24. The player increases the bet by one credit each time the player pushes the bet one button 24. When the player pushes the bet one button 24, the number of credits shown in the credit display 16 decreases by one, and the number of credits shown in the bet display 22 increases by one.

Gaming device 10 includes a display device 30 which, for a slot machine, contains a plurality of reels 32, preferably three to five reels in mechanical or video form. Each reel 32 displays a plurality of indicia such as bells, hearts, fruits, numbers, letters, bars or other images that preferably correspond to a theme associated with the gaming device 10. If the reels 32 are in video form, the gaming device 10 preferably displays the video reels 32 on a video display 30.

In other embodiments, the display device 30 of the gaming device 10 displays indicia and symbols relating to the primary games such as video poker, blackjack and keno. The present invention applies to any gaming device 10 in which the player stands or sits to play the game, regardless of which games are included in the gaming device 10.

Figure 3:
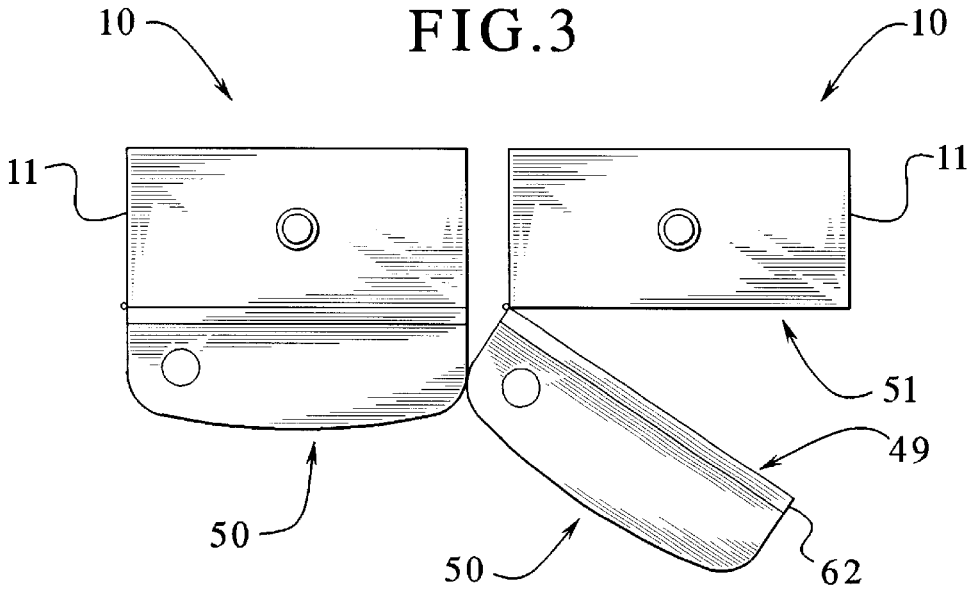
FIG. 3 is a top plan view of adjacent gaming devices illustrating the problem caused by extended permanently mounted bolsters.

The gaming device 10 of the present invention has a cabinet 11 with an access door 49. The access door 49 supports the moveable and/or removable bolster 50 of the present invention. The door 49 is pivotally connected to the cabinet 11, preferably along one of the sides of the cabinet 11, using a hinge or hinges (not shown). The cabinet 11 defines an opening or port 51 to access the interior of the gaming device 10 as illustrated in FIGS. 3, 5 and 6. A bolster 50 is connected to the gaming device 10, preferably connected to door 49, using any suitable adjustable mechanism. The bolster 50 may be connected to the gaming device 10 as described in detail below or in another suitable fashion.

The bolster 50 generally has a cushioned support 52 that a player uses to make himself or herself more comfortable while playing the gaming device 10. The player can rest their hands or their elbows on the support 52, which is preferably adapted to support a portion of the player's weight. The cushioning of the support 52 provides a comfortable place for the player to rest. The player may also rest items and belongings on the support 52.

The support 52 is a single piece of soft material, which may or may not include a protective (and decorative) cover. The support 52 may be constructed from any suitably soft and/or foamed material including urethane, polyvinylchloride, polyvinylacetate, natural rubber, synthetic rubber, etc. While it is preferred that the support 52 is formed as a single integral unit, the support 52 may alternatively be formed of a plurality of units, of the same or different material, which are suitably joined together.

Although not illustrated, the bolster 50 includes an internal metal or hard plastic structure around which the support 52 is formed. In one embodiment the internal structure is surrounded by a mold, wherein urethane foam is injected to fill the space between the mold and the internal structure. The foam cures and forms the desired shape of the support 52 of the bolster 50. The urethane foam forms a skin when cured, so that a separate cover is not necessary, although the bolster may alternatively include a separate cover, e.g., of vinyl or leather, if a certain look or feel is desired. The support 52 may be any color or have any desired pattern, lettering or graphics.

Figure 5A:
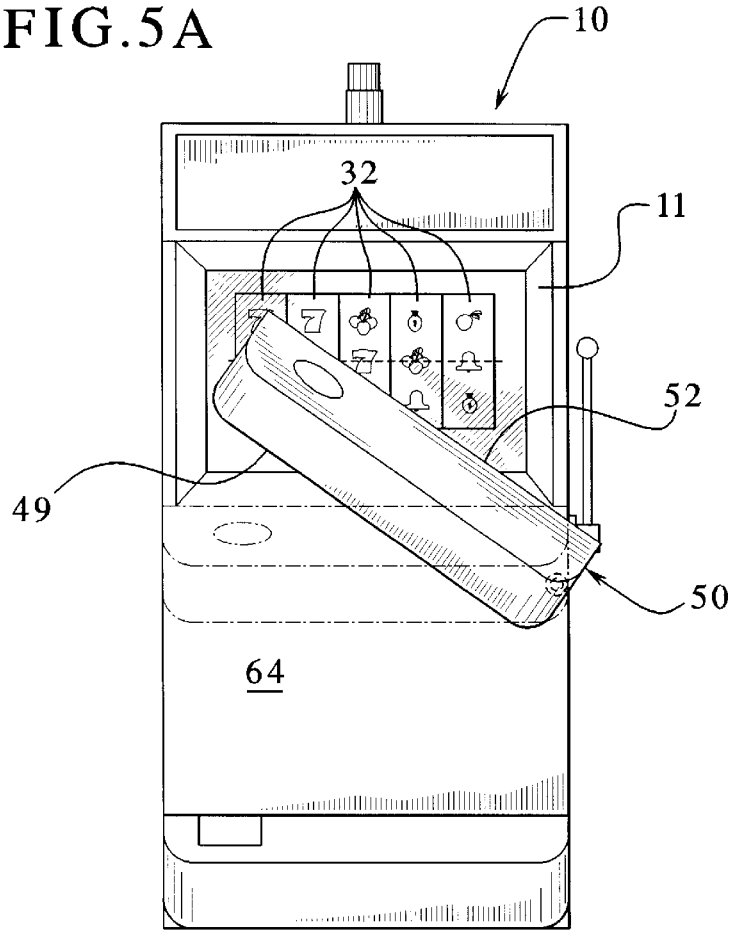
FIGS. 5A to 5C are views of embodiments of the gaming device of the present invention illustrating the front door of one of the cabinets in an open position with the bolster in a rotated position.
Figure 5B:
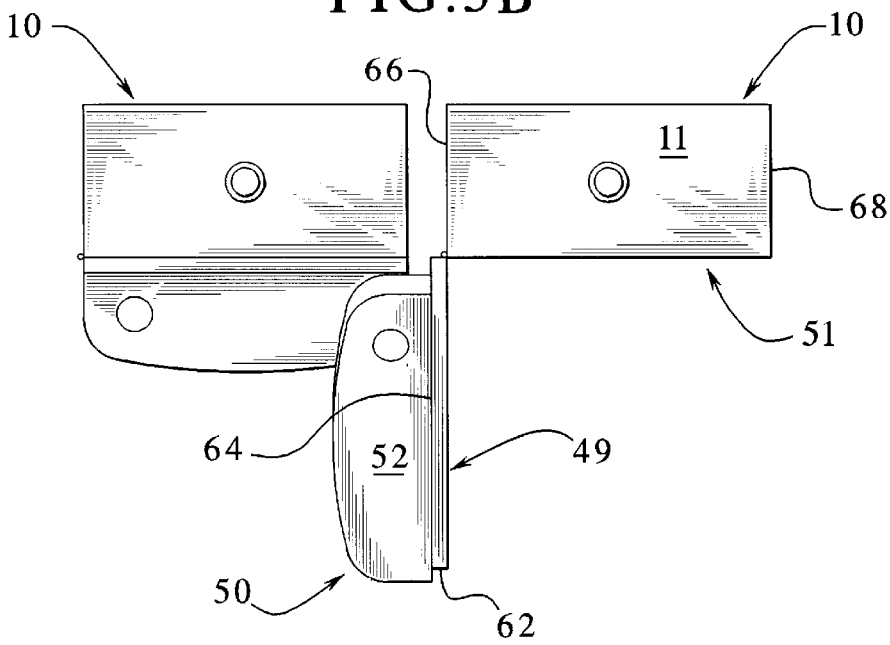
Figure 6:
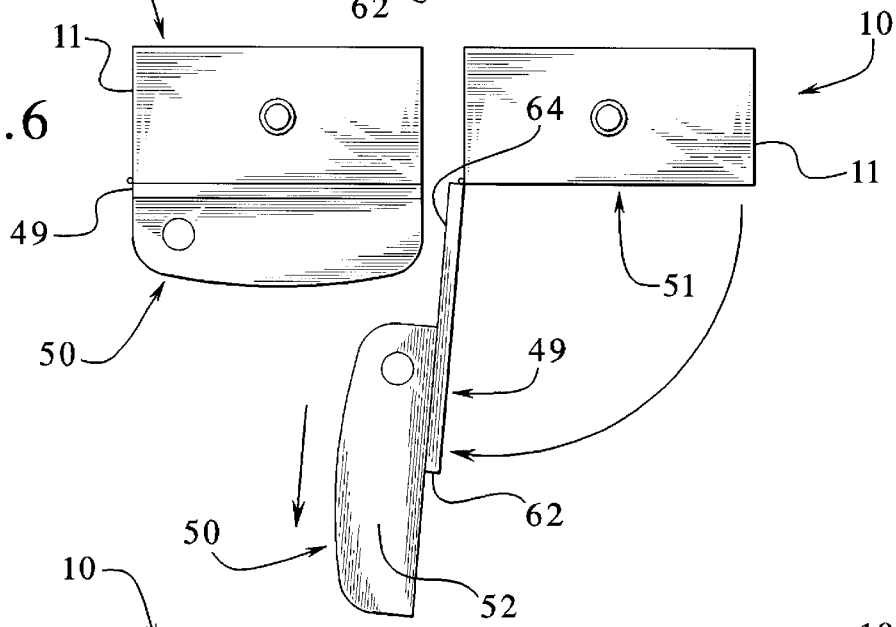
FIG. 6 is a top plan view of one embodiment of the gaming device of the present invention illustrating the front door of one of the cabinets in an open position with the bolster in an adjusted or moved position.

Turning now to FIGS. 5A and 5B, one embodiment of the gaming device 10 having adjustable bolster 50 is generally illustrated. In this embodiment, the bolster 50 is connected to the cabinet 11 in a moveable manner using a suitable rotating mechanism (discussed below). Preferably, the rotating mechanism includes a pivot device and locking mechanism (discussed below) which connect the bolster 50 to the cabinet 11. The locking mechanism locks the bolster 50 in a first, useable position, preferably a horizontal position enabling the patron to rest on the bolster 50.

Disengaging the locking mechanism enables the adjustable bolster 50 to rotate about a pivot to a second or angular position exposing at least a portion of front surface 64 of the door 49 as illustrated. As also illustrated in FIG. 5B, this enables the door 49 to be opened, providing access to the gaming device interior through port 51, without interfering with an adjacent gaming device 10 as shown. FIG. 5B illustrates that the bolster 50 clears above the bolster of an adjacent gaming device 10. In another embodiment, the bolster 50 swings downwardly. That is, the bolster 50 is connected to the cabinet 11 in a moveable manner so that the bolster 50 of one gaming device 10 (on the right) clears above or below, and does not interfere or impinge the bolster 50 of an adjacent gaming device 10 (on the left).

In one preferred embodiment, the door 49 supports the bolster 50 and hinges to one side 66 of the cabinet 11. The door 49 has an opening edge 62, opposite the hinge side 66, that swings away from the opening side 68 of the cabinet 11. The bolster 50, in turn, is rotatably or pivotally connected to a panel 64 of the door 49. The bolster 50 pivots at a point nearer to the opening edge 62 of the door 49. In the playing position, the bolster 50 locks to the panel 64 nearer to the hinge side 66 of the cabinet 11. In this preferred embodiment, the bolster 50 pivots on the side 68 of the cabinet 11 opposite to the hinge side 66 of door 49.

Unlocking the bolster 50 enables the bolster 50 to rotate to a second position at a predefined angle, so that the rotated bolster 50 cannot hit or impinge an adjacent bolster 50. The bolster 50 can rotate to any desired angle. For example, the bolster could rotate to twenty to ninety degrees or more. In one embodiment, the bolster 50 rotates to thirty-five degrees.

Figure 5C:
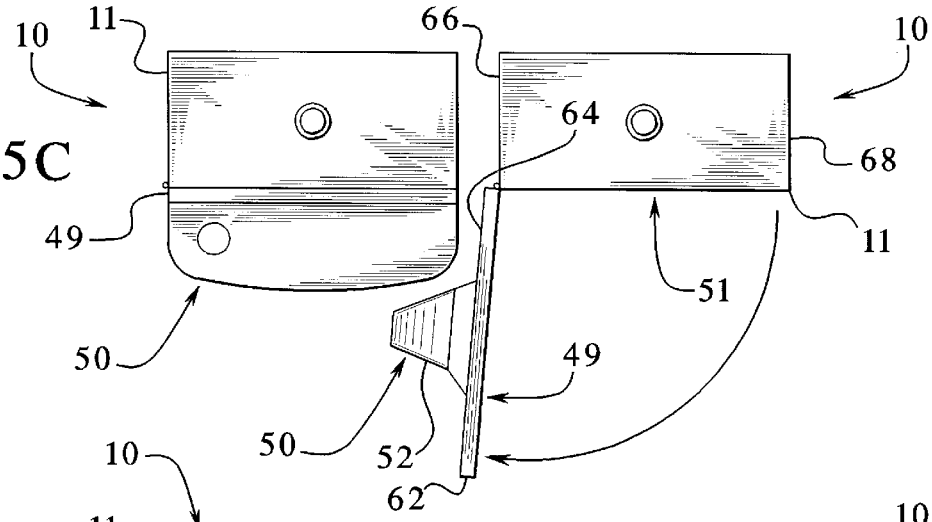

The door 49 may thereafter be fully opened to provide maximum access to the gaming device 10 interior without interfering with an adjacent gaming device 10. Although the bolster 50 preferably pivots at a point on the panel 64 nearer to the opening edge 62 of the door 49, the bolster may alternatively be adapted to pivot at a point in the middle of the panel 64 as illustrated in FIG. 5C, as long as the bolster rotates sufficiently to clear an adjacent bolster 50.

Another embodiment of the present invention includes the moveable mechanism illustrated in FIG. 6. In this embodiment, the moveable mechanism includes any suitable sliding mechanism (such as a track and sliding device connected to the front cabinet) and a locking mechanism (such as tabs that engage the track). The locking mechanism locks the bolster 50 in the first or useable position where it may be used by the patron.

Disengaging the locking mechanism enables the bolster 50 to slide relative to the door 49, until at least a portion of the bolster extends past edge 62, exposing cabinet surface 64. In this embodiment, the bolster 50 does not engage the adjacent gaming device 10 and does not interfere with that device. In this position, the access port 51 is exposed providing access to the interior of the gaming device.

Figure 7:
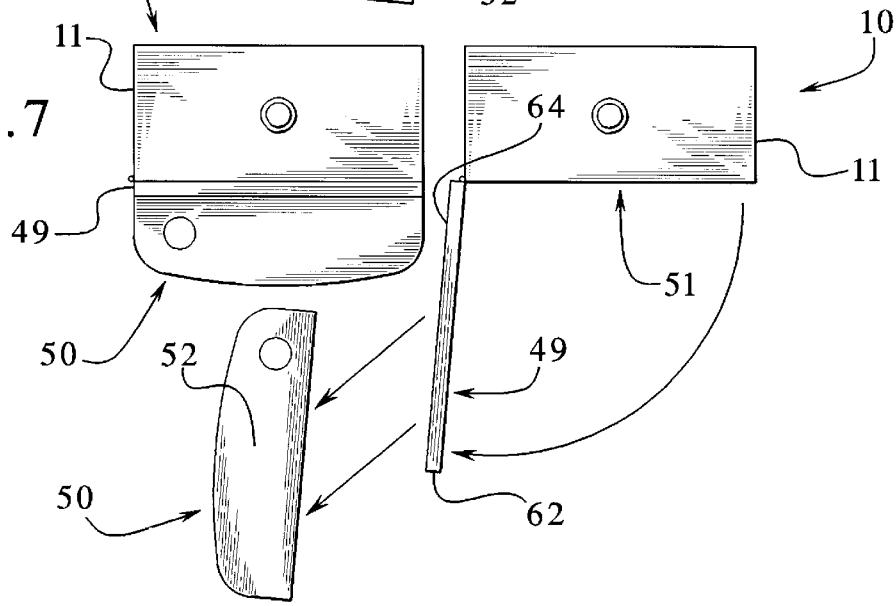
FIG. 7 is a top plan view of one embodiment of the gaming device of the present invention with the front door of one of the cabinets in an open position with the bolster detached from the front door.

A further alternative embodiment of the present invention includes a removable bolster 50 as illustrated in FIG. 7. In this embodiment, the bolster 50 includes a releasable locking device including screws, hooks, tabs, pegs, or other suitable mechanism, that co-act with a reciprocating member connected or formed on the door 49 of gaming device 10. The bolster 50 is placed on the gaming device 10 and is firmly locked into place in a first position. To access the interior of the device 10, the locking device is disengaged, and the entire bolster 50 is lifted away from the cabinet 11, exposing surface 64. The cabinet 11 may be opened, defining access port 51 and providing access to the interior of the gaming device 10.

The bolster 50 is removably attached to the cabinet 11 so that the door 49 may be fully opened after the bolster 50 is removed. The removable bolster 50 feature may be adapted to replace the moveable bolster 50 feature or operate in conjunction with it. For example, it may be quicker and easier not to fully remove the bolster 50 for most servicing but helpful to remove the bolster 50 for some types of servicing.

Moveable Bolster with Pivoting Device

Referring now to FIGS. 8 to 14, one preferred embodiment of the moveable bolster assembly 70 of the present invention is illustrated. The removable bolster assembly 70 of this embodiment of the present invention is attached to a portion of the panel 64 of the door 49 of the gaming device. The inner surface support 52 of the bolster 50 is substantially convex to conform to the outer (i.e., player side) surface of the panel 64. An elongated U-shaped support channel 72 for supporting the removable bolster assembly 70 is suitably conformed to be attached to or mounted to the concave inner surface of the panel 64. The channel 72 may be constructed of aluminum, steel, stainless steel or any other suitable material. The removable bolster 70 of this embodiment generally includes a locking device or mechanism 74 and a pivoting device or mechanism 76 attached to the U-shaped support channel 72.

The locking device 74 includes a housing 78, a spring loaded pin 80 mounted in the housing, a pulley 82 attached to the housing 78, a release knob 84 and a cable 42 fastened at one end to knob 84 and at the other end to pin 80. The housing 78 is attached to the channel 72 and includes a plurality of surfaces 75 and 77 which limit the movement of the cable 42 about the pulley 82. The cable thus extends from the pin 80, around the pulley 82, through a guide 44 at a fastening point 86 attached to the U-shaped support channel 72 (to stay clear of other devices on the inside of the gaming device 10) to the knob 84.

The bolster assembly 70 also includes a mounting bracket 96 attached to the U-shaped channel 72. The mounting bracket 96 which is preferably steel or stainless steel supports a number of components of the bolster assembly 70 including the knob 84. The knob 84 in the illustrated embodiment secures to the mounting bracket 96 by a pair of hex nuts (see FIG. 8). It should be appreciated that the knob could otherwise suitably mount to the support.

Figure 9:
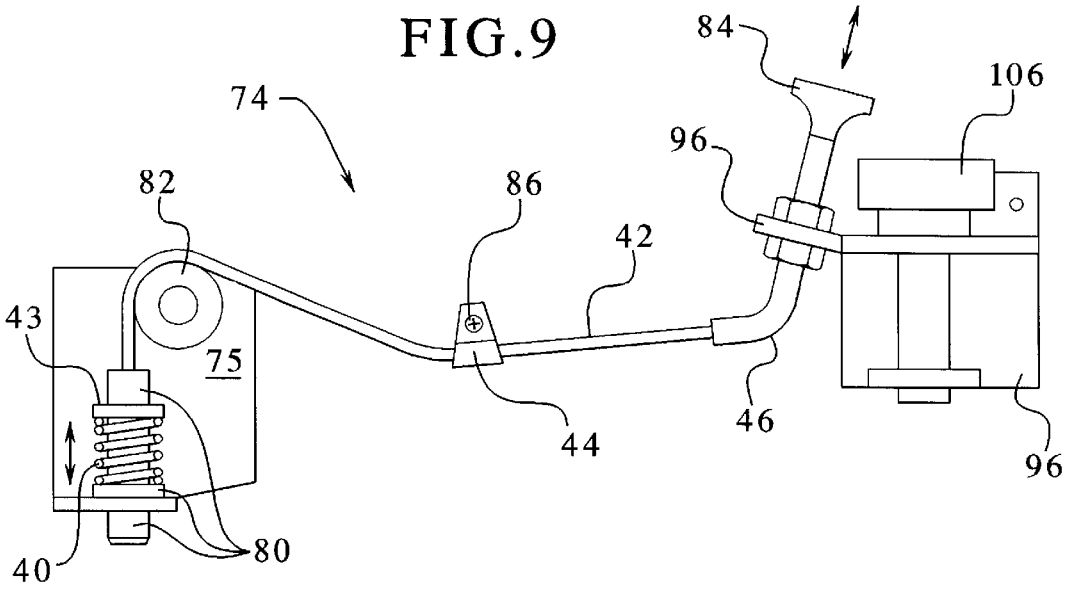
FIG. 9 is a schematic top plan view of one embodiment of the locking device of the present invention.

The housing 78 also provides a base 43 for a compression spring 40 as illustrated in FIG. 9. The compression spring 40 biases the pin 80 outwardly towards the bolster 50. More specifically, the spring biases the pin 80 towards a slot 98 (FIG. 10) in the bolster to lock the bolster 50 in the closed position. When the bolster 50 is in the closed and locked position, the locking pin 80 extends into slot 98 of a metal locking clip 100 attached to the inner surface 54 of the bolster or other structure inside the bolster 50 (see FIG. 10) to prevent the bolster 50 from rotating about the pivot 92 as discussed below.

The bolster assembly 70 also preferably includes an L-shaped steel catch 88 (see FIG. 8) attached to the panel 64 and a rubber bumper 90 mounted to the catch 88. The catch 88 is suitably secured and formed to support the bolster and the weight of a player leaning on the support 52 of the bolster. A bent metal tab 104 (see FIG. 10) is attached to the inner surface 54 of the bolster or a structure in the bolster 50. The tab 104 includes a cutout 102 adapted to receive the L-shaped catch 88. The catch 88 supports the weight placed on the bolster 50 to avoid undue stress on the pin 80.

FIG. 9 illustrates the locking device 74 with a portion of the housing 78 removed to better illustrate the compression spring 40 that biases pin 80 into slot 98 of the bolster 50. It should be appreciated that the spring 80 also maintains the tension in the cable 42 attached to the pin 80. To open the door, the operator or technician partially opens the door 49 to grasp (and pull) the knob 84 positioned near the opening end 62 of the door 49. Pulling the knob 84 causes the pin 80 to disengage the slot 98 in the bolster 50 to unlock the bolster 50.

The pivoting device 76 includes a pivot 92 which transversely extends from the inner surface 54 of the urethane support 52 and is secured to a suitable structure (not shown) in the bolster 50. The pivot 92 in one embodiment is a steel or stainless steel cylindrical solid rod, tube or pipe. The pivot 92 extends through a suitably sized aperture 94 defined by the panel 64.

The pivoting device 76 includes a collar 106 (best seen in FIG. 8) secured to the pivot 92 by one or more set screws, and an arm or stopper 108 (best seen in FIG. 10) suitably mounted to the side of the collar 106. The pivot 92, collar 106 and arm or stopper 108 rotate with the bolster 50.

When the bolster 50 is in the closed and locked position, the arm 108 engages pin 113 (see FIG. 10) which is biased downwardly by the compression spring 112 journaled around pin 113 between the washer 110 and a base 97 of the mounting bracket 96. The pin 113 is threaded into and/or welded to the mounting bracket 96 and extends downwardly therefrom. The washer 110 and nut 116 (FIGS. 11 and 12) hold the spring 112 in place. In the closed and locked position, the bolster 50 compresses the spring 112, such that the spring is biased to rotate the bolster 50 upwardly when the operator pulls the knob 84 and releases or unlocks the pin 80 from the aperture 98 of the locking clip 100 attached to the bolster 50 as described above.

In one embodiment of the bolster assembly 70, the spring 112 rotates the bolster 50 to a preliminary angle such as five degrees from the horizontal or closed position. The primary purpose of this preliminary angle is to hold the bolster 50 slightly open so that it does not re-lock. Otherwise, if the operator releases the knob 84, the spring 40 biases the pin 80 back into the aperture 98, thereby re-locking the bolster 50.

In one embodiment, the stopper 108 defines a hole 114 (best seen in FIG. 11) that is suitably sized to clear the nut 116 that holds the washer 110 in place. The hole 114 does not clear the washer 110 and the stopper 108 contacts the washer 110 such that when the bolster 50 rotates downwardly to the closed position, the spring 112 compresses.

Figure 12:
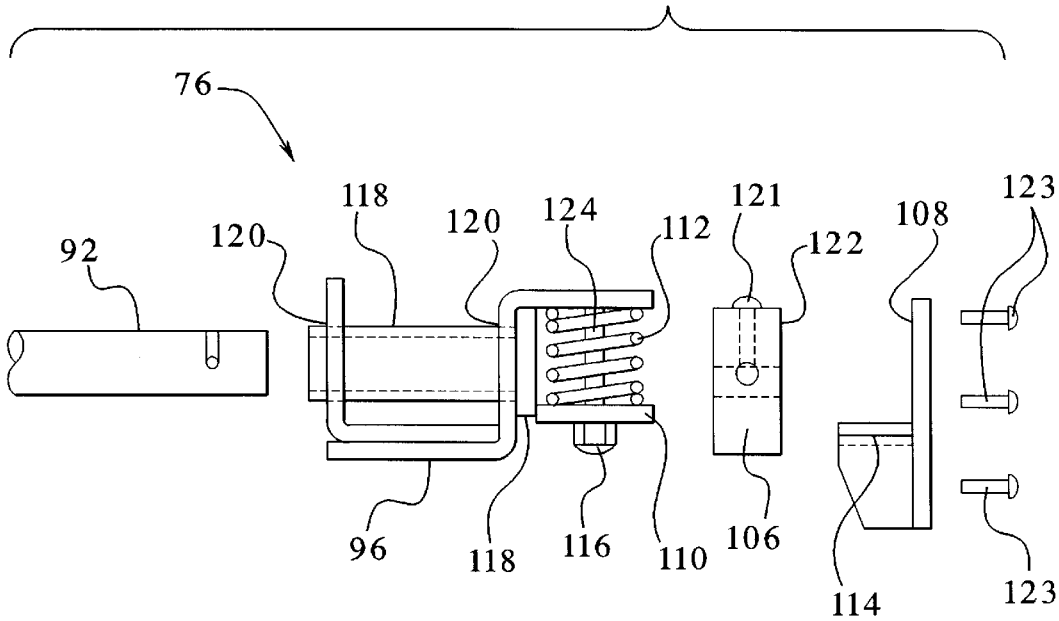
FIG. 12 is an exploded schematic side view of the preferred pivoting device of the present invention.
Figure 10:
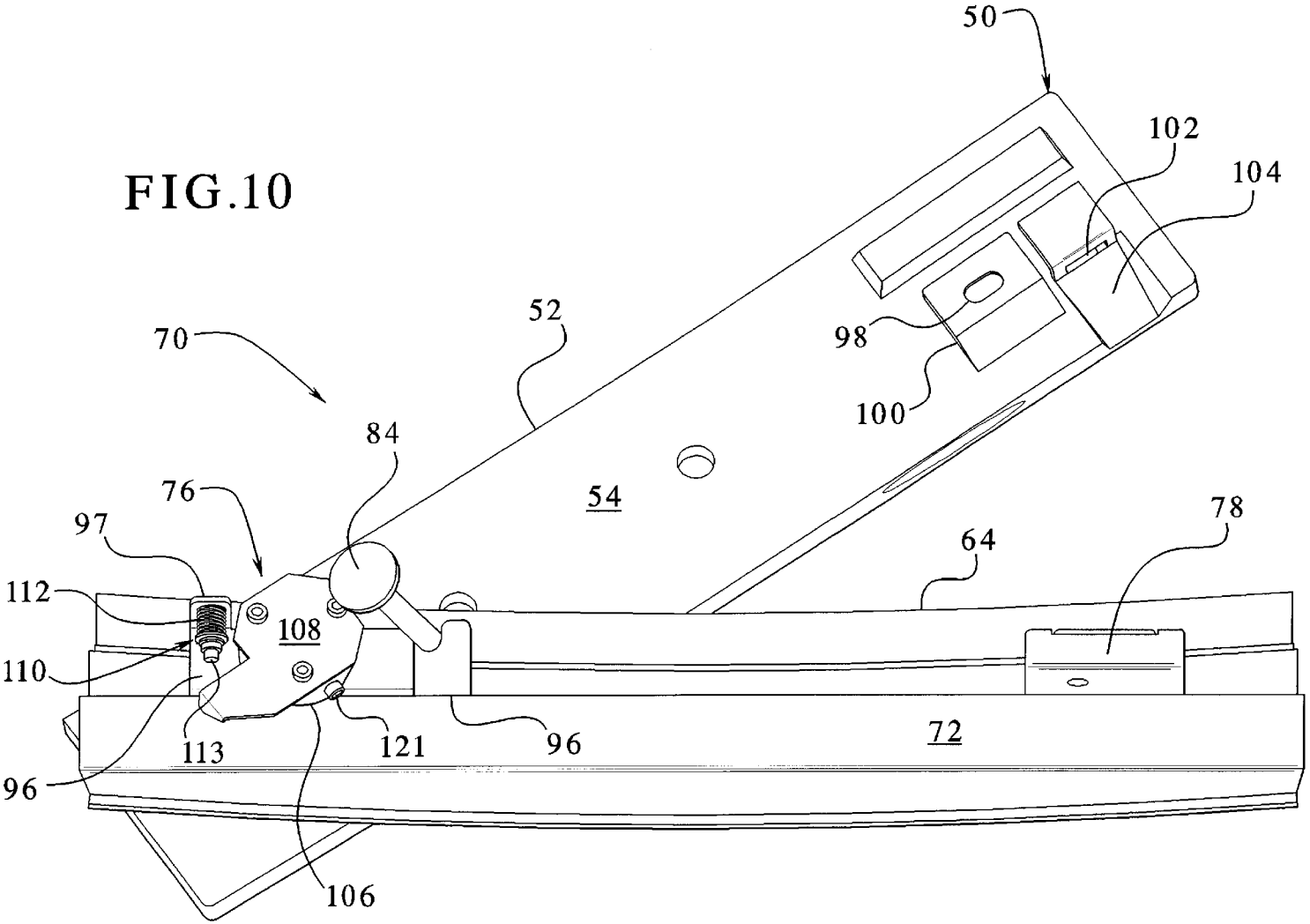
FIG. 10 is a perspective view of a portion of a door panel having the locking device, preferred pivoting device and removable bolster of the present invention.

The pivot 92, which is preferably integrally welded or otherwise connected to an inner structure of the bolster 50, is pivotally mounted in a bushing 118 or bearing (see FIG. 12). In one embodiment, the pivot 92 rotates inside a bushing made of oil impregnated bronze. The bushing 118 is fit into a bearing aperture 120 defined by the mounting bracket 96. When in position, the collar 106 is mounted on the pivot 92 and a set screw 121 fastens the collar 106 to the pivot 92, securing the pivot 92 to the mounting bracket 96. The stopper 108 is fastened to the inner face 122 of the collar 106 by screws 123.

Figure 13A:
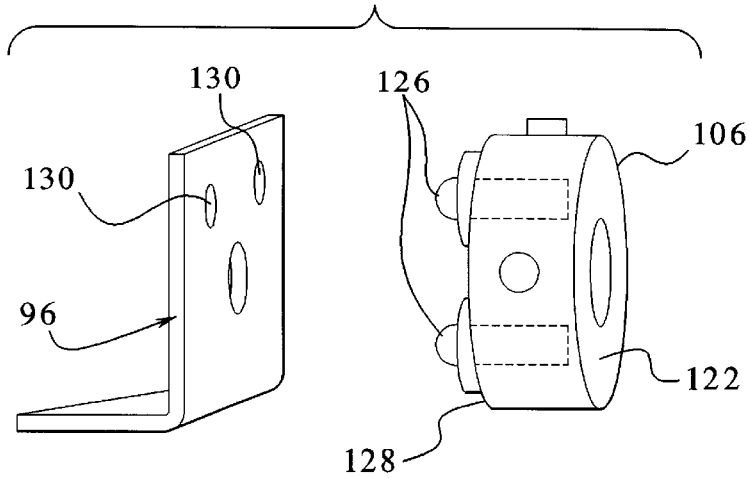
FIG. 13A is a perspective view of an operating angle setting portion of the preferred pivoting device of the present invention.
Figure 13B:
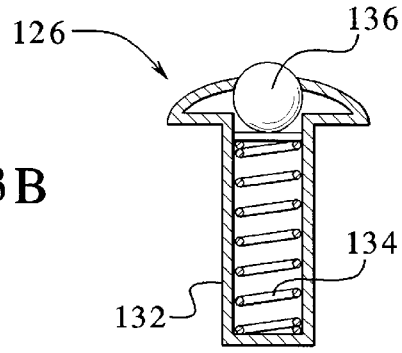
FIG. 13B is a cross-sectional view of a spring loaded ball bearing used in the operating angle setting portion of the present invention.

Referring now to FIGS. 13A and 13B, an exploded view of the mounting bracket 96 and the collar 106 illustrate how the bolster 50 is taken from the preliminary predefined angle of approximately five degrees to the operating angle, e.g., twenty to ninety degrees and in one embodiment about thirty-five degrees, which enables the bolster 50 to clear the bolster of an adjacent gaming device. As discussed above, when the operator pulls the release knob 84, the bolster 50 unlocks and the spring 112 rotates the bolster up to the preliminary angle of, e.g., five degrees. Thereafter, the operator rotates the bolster 50 from the preliminary angle to the predefined operating angle.

Figure 8:
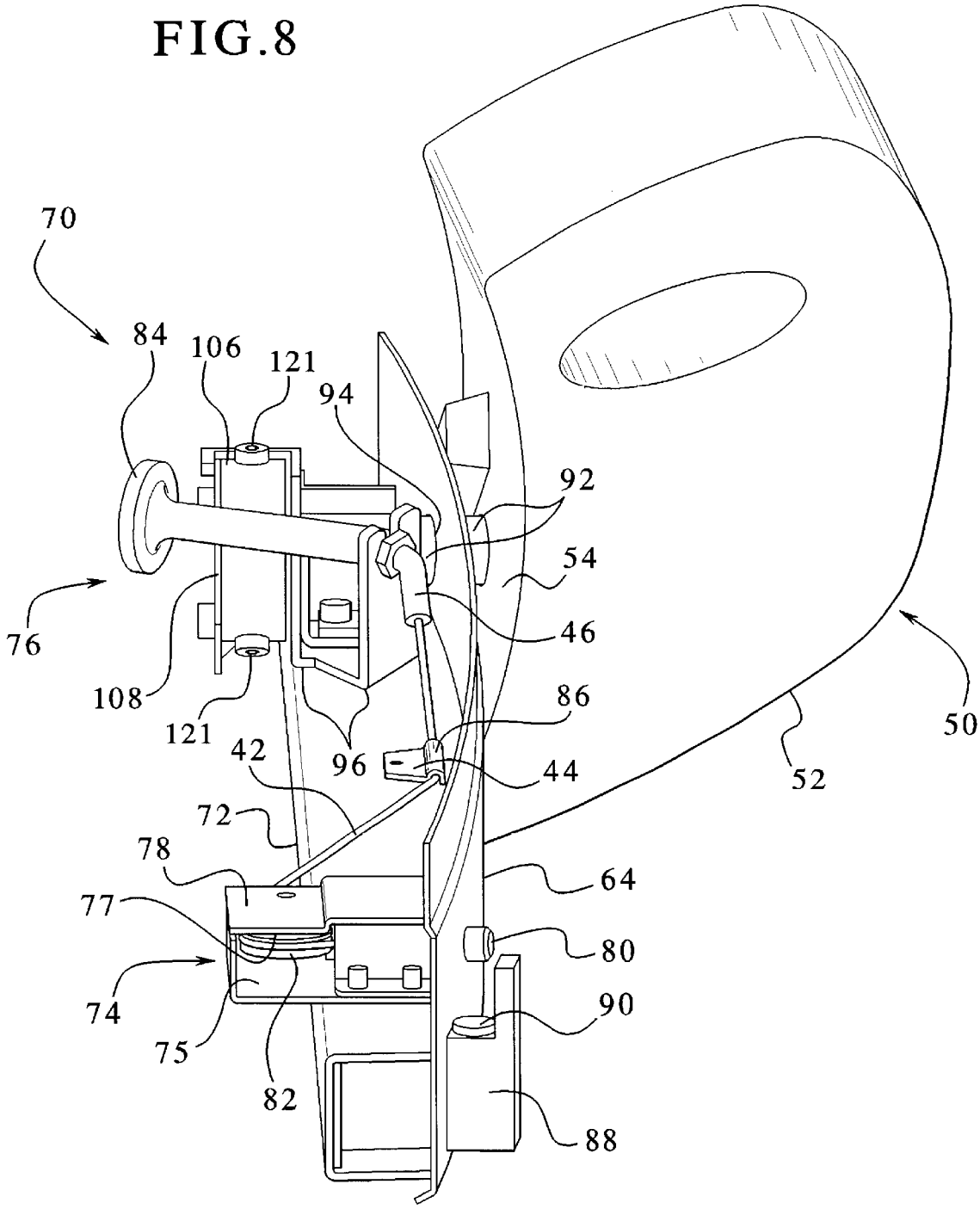
FIG. 8 is a perspective view of a portion of a door panel having the locking device, preferred pivoting device and removable bolster of the present invention.
Figure 11:
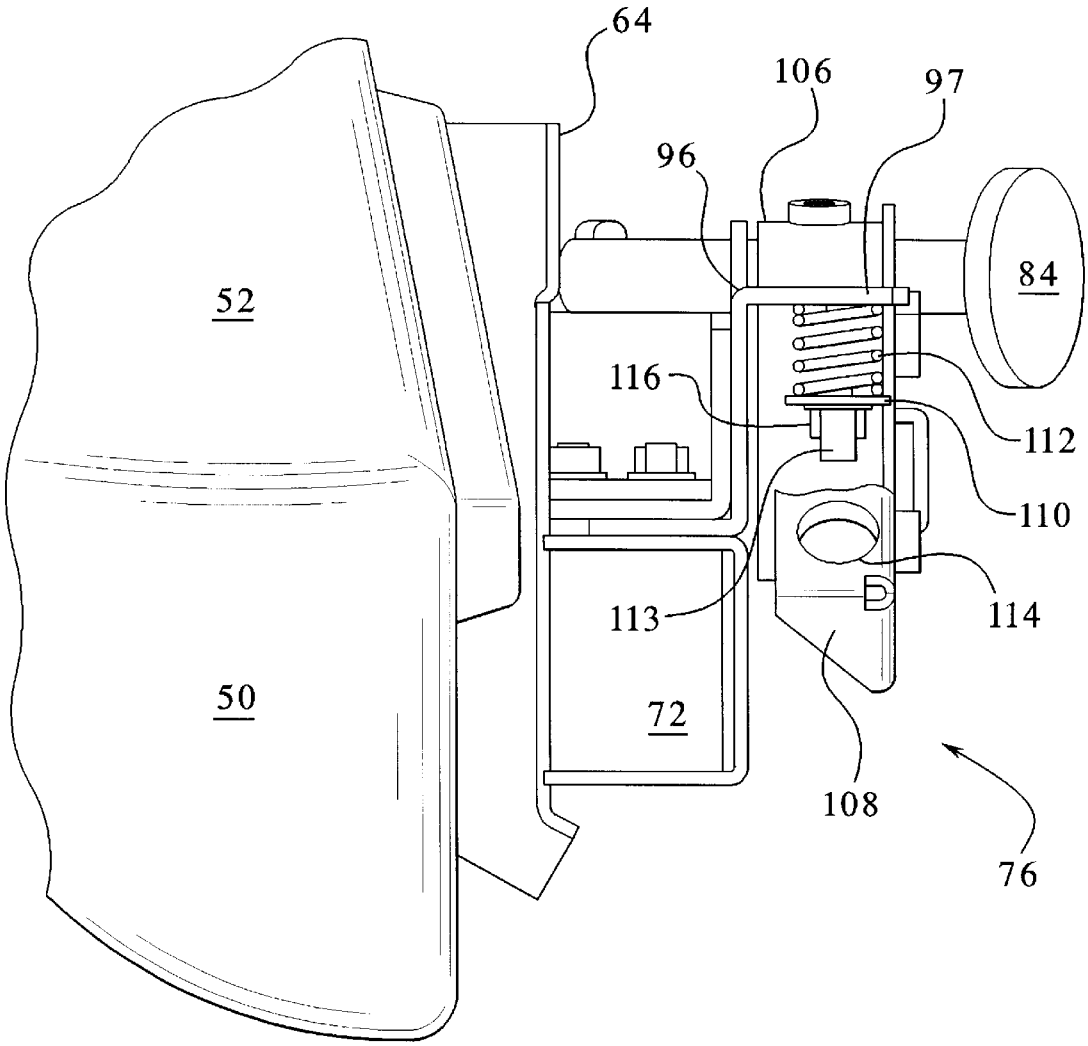
FIG. 11 is a perspective view of a portion of a door panel highlighting the preferred pivoting device and removable bolster of the present invention.

As illustrated in FIG. 13A, when the bolster reaches the operating angle of, e.g., approximately thirty-five degrees, a number of spring loaded detents or ball bearings 126 imbedded or press fit into the outer flat surface 128 (opposite the inner surface 122 connected to the stopper 108) of the collar 106 engage mating sockets 130 defined by the mounting bracket 96. FIGS. 8 and 11 illustrate that the collar 106 is mounted virtually flush against a wall of the mounting bracket 96. When the operator manually rotates the collar 106, the ball bearings 126 roll along the mounting bracket 96 until the ball bearings 126 reach the sockets 130 in the mounting bracket 96, which occurs when the bolster has reached the preferred operating angle. The ball bearings 126 and the sockets 130 are preferably radially or axially spaced apart so that no ball bearing engages a socket 130 until the bolster 50 is in its operating position.

FIG. 13B illustrates a cross-section of the housing 132 of the spring loaded ball bearing 126 and a compression spring 134 which biases the preferably steel ball 136 toward an opening in the housing 132 that allows some, but not all of the ball 136, to extend from the housing. The ball 136 and spring 134 provide tactile feedback to the operator when the bolster 50 "snaps" into place, i.e., the balls 136 snap into sockets 130.

The spring 134 and the number of bearing and socket pairs are selected: (i) such that the pairs suitably hold the bolster at the predefined operating angle, such as about thirty-five degrees, even when the operator swings the door 49 fully open; and (ii) such that the operator may disengage the balls 136 from the holes 130 (e.g., to close the bolster 50) without using undue force. Upon closing or pushing the bolster 50 back to its horizontal position, the edge of the socket 130 provides a force that compresses the spring 134, so that each ball 136 rolls out of its corresponding socket 130.

It should be appreciated that once the operator opens the main door 49 of gaming device 10, unlocks the bolster 50, and rotates the bolster 50 to the operating angle, the ball bearings 126 hold the bolster 50 in the operating position even after the operator closes the main door 49. This feature enables the operator to close the door 49 without resetting any type of latch or apparatus beforehand. Further, the operator can perform maintenance on the bolster 50 or the area behind the bolster while the door is closed. The feature provides flexibility for the operator.

Figure 14:
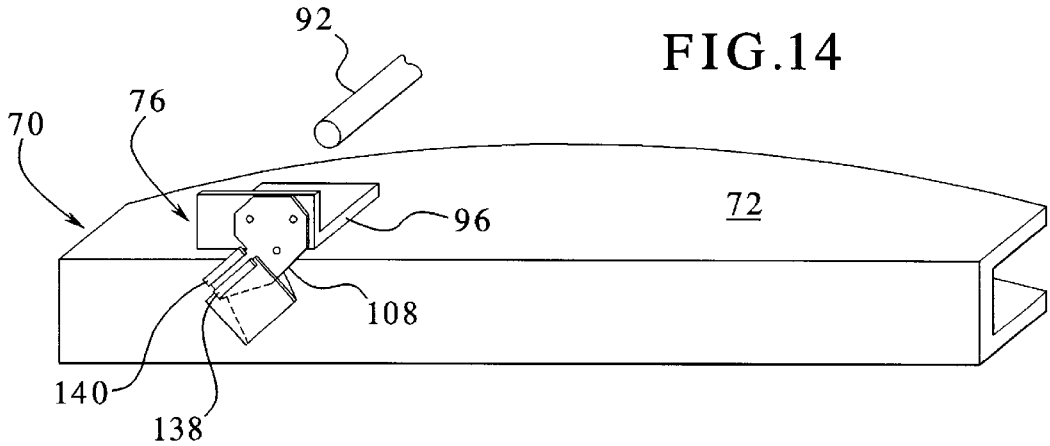
FIG. 14 is a schematic representation of one embodiment for a hard stop of the present invention.

Referring now to FIG. 14, a hard stop feature of the present invention is diagrammatically illustrated. It should be appreciated from FIGS. 13A and 13B that spring loaded ball bearings 126 and the socket 130 do not stop an operator from rotating the bolster 50 past the desired operating angle. The operator is preferably not able to rotate the bolster so that it hits the casino floor or extends out into the isle of the casino. The preferred bolster assembly 70 therefore contains a limiter 138 positioned at an angle greater than the operating angle of the bolster. The limiter 138 in an embodiment is positioned at an angle approximately 20 degrees greater than the operating angle. If the operating angle is thirty-five degrees, then the limiter 138 may be set at about fifty-five degrees.

In FIG. 14, one embodiment of a limiter 138 includes a bent cutout in the U-channel 72, which is bent away from the support channel 72, towards the inside of the gaming machine. The bent metal stopper 108 has a flange 140 that contacts the limiter 138 when the bolster is rotated to its maximum position. The limiter 138 may be adapted to be a separate bent metal piece which is suitably bolted or welded to the support channel 72. Alternatively, the bent metal mount 96 may be adapted to provide the limiter.

Moveable Bolster with Alternative Pivoting Device

Figure 15:
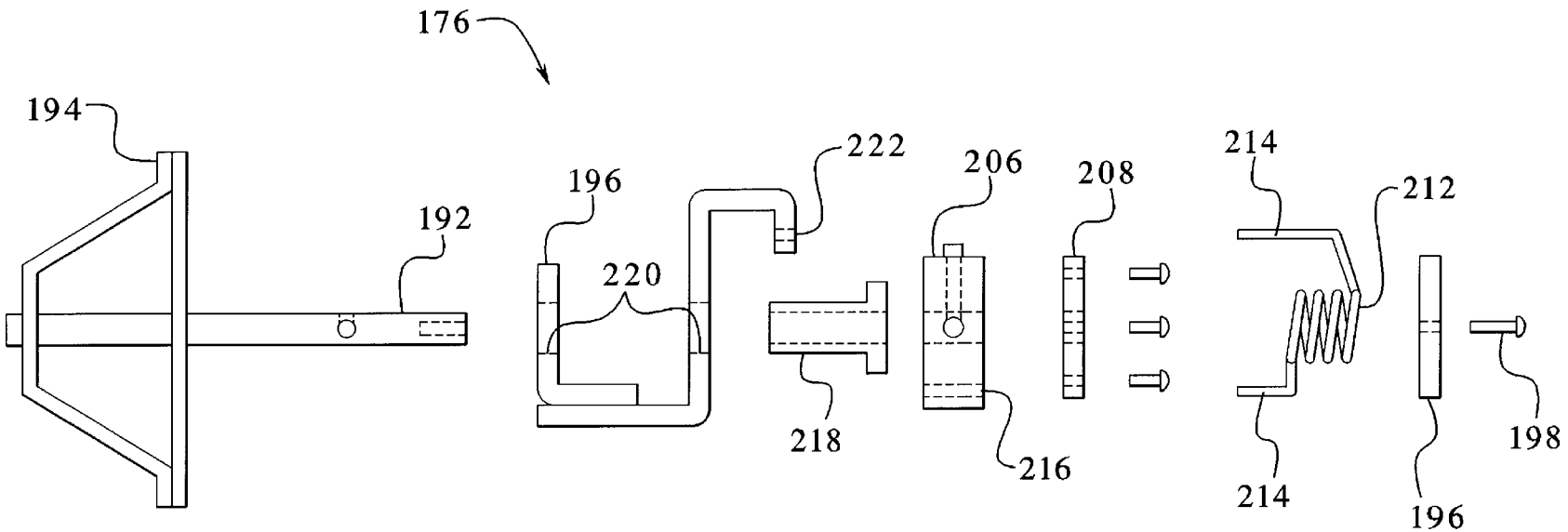
FIG. 15 is an exploded schematic side view of an alternative pivoting device of the present invention.

Referring now to FIG. 15, an exploded view of an alternative pivoting device 176 is generally illustrated. The alternative pivoting device includes many of the same components having the same functionality as described above; namely: (i) a pivot 192 that is preferably fixed or welded to the internal structure 194 of the bolster which is illustrated in FIG. 15 without the cushioned support 52; (ii) a mounting bracket 196; (iii) a plurality of bearing holes 220 defined by the mounting bracket 196; (iv) a bushing 218 press fit into the holes 220; (v) a collar 206 connected to the pivot 102 by one or more set screws; and (vi) a stopper 208 fastened to the collar 206.

The primary difference in the alternative pivoting device 176 is that it employs a torsion spring 212 as opposed to the compression spring 112 of the preferred pivoting device 76. The torsion spring 212 is secured to the pivoting device 176 by a washer 196 and bolt 198. The torsion spring 212 has two arms 214. One arm fits into an aperture 216 defined by the collar 206. This arm couples to the rotatable collar 206, pivot 192, bolster structure 194 sub-assembly. The other arm fits into a hole 222 defined by the mounting bracket 196, which is fixed to the support channel. This arm couples to a non-rotatable, fixed piece.

The torsion spring 212 may be adapted to open up to ninety or one hundred eighty degrees when released. Therefore, in operation, when the operator unlocks the bolster 50 by pulling the release knob 84, the alternative torsion spring 212 causes the bolster to automatically open to the predefined operating angle, e.g., about thirty-five degrees. The stopper 208 hits a limiter (not illustrated but similar to limiter 138) set at the appropriate operating angle. The alternative pivoting device 176 therefore bypasses the preliminary angle/manual operation feature of the preferred pivoting device 76. While the alternative pinning device 176 is mechanically simpler, it could create an undesirable situation if the spring 212 is too stiff for the bolster 50 and the bolster 50 releases too quickly or is too difficult to re-lock.

In any of the embodiments described herein, the bolster 50 may be moveable and removable. That means the bolster 50 may be translatable and moveable or rotatable and removable. For example, the pivot 92 of FIGS. 8 through 14 and the pivot 192 of FIG. 15 can contain a removable pin or other quick release mechanism that allows the pivots 92 and 192 and thus the bolster 50 to uncouple from their respective collars 106 (FIG. 12) and 206 (FIG. 15). That is, the quick release pin would take the place of the set screw 121 (FIG. 12). Even in the embodiments shown, the bolster 50 can be removed by loosening the set screw, albeit with a tool. Thus, the bolster 50 is rotatable and removable. Similarly, in FIG. 6, the bolster 50 may contain a quick release pin along the track or sliding mechanism that holds the bolster 50 to the door 49 and enables the bolster 50 to slide relative to the door. The bolster 50 is therefore also translatable and removable.

It should be appreciated that other embodiments are contemplated. For example, other members or portions of the gaming device 10 could be moveable or removable in accordance with the present invention. The bolster could incorporate a cup holder, ash tray, etc. In another embodiment the bolster is connected to an extending member (not shown), where the extending member is in turn connected to the door of the cabinet. In this embodiment, the extending member includes corresponding first and second surfaces. Here, the second edge is moveably connected to the extending member first surface while the extending member second surface is fixedly connected to the door to the gaming apparatus. For example, this embodiment could include a pair of sliding rails, where one rail is connected to the extending member first surface and the other rail to second edge, so that the bolster is adjustable with respect to the extending member. It should also be appreciated that the bolster is rotatably or removably connected to the extending member as discussed previously.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a cabinet;

a door pivotably connected to the cabinet; and a bolster directly and moveably connected to the door via a release mechanism biased to move the bolster automatically upon release of the release mechanism.

2. The gaming device of claim 1, wherein the bolster is connected to the door by a sliding mechanism.

3. The gaming device of claim 2, wherein the sliding mechanism includes a locking mechanism.

4. The gaming device of claim 1, wherein the bolster is connected to the door by a rotating mechanism.

5. The gaming device of claim 4, wherein the rotating mechanism includes a locking device.

6. The gaming device of claim 4, wherein the rotating mechanism includes a pivoting device.

7. A gaming device comprising:

a cabinet;

a door pivotally connected to the cabinet; and a bolster directly and removably connected to the door via a releasable locking mechanism provided behind the door.

8. A door pivotally connected to a gaming device cabinet comprising:

a panel;

a bolster connected to the panel by a single pivot such that the bolster is able to clear another bolster mounted to another gaming machine adjacent to the cabinet when the panel is opened; and a locking device affixed to the panel having a locking member that engages and releasably locks the bolster when the bolster is in a closed position.

9. The gaming device of claim 8, wherein the locking member includes a pin attached to a cable which extends adjacent to an opening edge of the panel so that the cable can be pulled to disengage the pin from an orifice in the bolster.

10. The gaming device of claim 9, which includes a knob attached to an opposite end of the cable from the pin, wherein the knob is positioned adjacent to an opening edge of the panel so that the knob can be pulled to disengage the pin from the orifice.

11. The gaming device of claim 9, which includes a spring which biases the pin outwardly from the door toward the orifice defined by the bolster.

12. The gaming device of claim 8, which includes a catch affixed to the panel so as to be in horizontal alignment with a member protruding inwardly from the bolster, the catch providing support for weight placed on the bolster.

13. The gaming device of claim 8, which includes a stopper connected to the pivot, the stopper configured to rotate with the bolster and to engage a flange affixed to the panel when the bolster is rotated to a predefined angle.

14. The gaming device of claim 13, which includes a spring which biases the bolster towards the predefined angle.

15. The gaming device of claim 8, which includes a collar connected to the pivot, the collar configured to rotate with the bolster and having a detent positioned to engage a socket when the bolster is rotated to a predefined angle.

16. The gaming device of claim 15, which includes a spring which biases the bolster towards the predefined angle.

17. The gaming device of claim 15, which includes a spring which biases the bolster to a preliminary angle such that the bolster can thereafter be manually rotated from the preliminary angle to the predefined angle.

18. The gaming device of claim 15, which includes a stopper mounted to the collar, the stopper configured to rotate with the bolster and to engage a flange affixed to the panel when the bolster is rotated to a maximum angle.

19. A method for enabling an operator to gain access to an interior of a gaming device cabinet, said method comprising the steps of:

(a) enabling a door pivotally connected to the front of the cabinet to be partially opened; and (b) providing an unlocking mechanism accessible through the partially opened door, which can be moved so that a bolster pivotally connected to the door unlocks and rotates to a predefined angle.

20. The method of claim 19, which includes the step of enabling the bolster, which has rotated to the predefined angle, to be further manually rotated to a second predefined angle.

21. The method of claim 19, which includes the step of providing a releasing mechanism accessible through the partially opened door, which can be moved so that the bolster is released from the door.

22. A gaming device comprising:

a cabinet;

a door pivotably connected to the cabinet; and a bolster directly and moveably connected to the door by a sliding mechanism.

23. The gaming device of claim 22, wherein the sliding mechanism includes a locking mechanism.

24. A gaming device comprising:

a cabinet;

a door pivotally connected to the cabinet so as to have an opening edge that swings away from a first side of the cabinet;

a bolster connected to the door by a pivot such that the bolster is able to clear another bolster mounted to another gaming machine adjacent to a second side of the cabinet when the door is opened; and a locking mechanism affixed to the door having a pin that protrudes from the door to engage an orifice defined by the bolster and to secure the bolster in a locked position, and wherein the pin is attached to a cable that extends adjacent to the opening edge of the door so that the cable can be pulled to disengage the pin from the orifice.

25. The gaming device of claim 24, wherein the pin is attached to one end of the cable and a knob is attached to an opposite end of the cable, wherein the knob is positioned adjacent to the opening edge of the door so that the knob can be pulled to disengage the pin from the orifice.

26. The gaming device of claim 24, which includes a spring which biases the pin outwardly from the door into the orifice defined by the bolster.

27. A gaming device comprising:

a cabinet having first and second sides;

a door pivotally connected to the cabinet so as to have an opening edge that swings away from the first side of the cabinet;

a bolster connected to the door by a pivot located proximate to an end of the bolster, the end positioned proximate to the first side of the cabinet when the door is closed such that the bolster is able to clear another bolster mounted to another gaming machine adjacent to a second side of the cabinet when the door is opened; and a catch affixed to the door so as to be in substantially horizontal alignment with a member protruding inwardly from the bolster, the catch providing support for weight placed on the bolster.

28. A gaming device comprising:

a cabinet;

a door pivotally connected to the cabinet so as to have an opening edge that swings away from a first side of the cabinet;

a bolster connected to the door by a pivot such that the bolster is able to clear another bolster mounted to another gaming machine adjacent to a second side of the cabinet when the door is opened; and a stopper connected to the pivot, the stopper configured to rotate with the bolster and to engage a flange affixed to the door when the bolster is rotated to a predefined angle.

29. The gaming device of claim 28, which includes a spring which biases the bolster towards the predefined angle.

30. A gaming device comprising:

a cabinet;

a door pivotally connected to the cabinet so as to have an opening edge that swings away from a first side of the cabinet;

a bolster connected to the door by a pivot such that the bolster is able to clear another bolster mounted to another gaming machine adjacent to a second side of the cabinet when the door is opened; and a collar connected to the pivot, the collar configured to rotate with the bolster and having a detent positioned to engage a socket when the bolster is rotated to a predefined angle.

31. The gaming device of claim 30, which includes a spring which biases the bolster towards the predefined angle.

32. The gaming device of claim 30, which includes a spring which biases the bolster to a preliminary angle so that the bolster can thereafter be manually rotated from the preliminary angle to the predefined angle.

33. A door pivotally connected to a gaming device cabinet comprising:

a panel;

a bolster connected to the panel by a pivot such that the bolster is able to clear another bolster mounted to another gaming machine adjacent to the cabinet when the panel is opened; and a locking device affixed to the panel having a locking member operable to engage and releasably lock the bolster when the bolster is in a closed position, wherein the locking device includes a pin attached to a cable which extends adjacent to an opening edge of the panel so that the cable can be pulled to disengage the pin from an orifice in the bolster.

34. The gaming device of claim 33, which includes a knob attached to an opposite end of the cable from the pin, wherein the knob is positioned adjacent to an opening edge of the panel so that the knob can be pulled to disengage the pin from the orifice.

35. The gaming device of claim 33, which includes a spring which biases the pin outwardly from the door toward the orifice defined by the bolster.

36. A door pivotally connected to a gaming device cabinet comprising:

a panel;

a bolster connected to the panel by a pivot such that the bolster is able to clear another bolster mounted to another gaming machine adjacent to the cabinet when the panel is opened;

a locking device affixed to the panel having a locking member operable to engage and releasably lock the bolster when the bolster is in a closed position; and a catch affixed to the panel so as to be in substantially horizontal alignment with a member protruding inwardly from the bolster, the catch providing support for weight placed on the bolster.

37. A door pivotally connected to a gaming device cabinet comprising:

a panel;

a bolster connected to the panel by a pivot such that the bolster is able to clear another bolster mounted to another gaming machine adjacent to the cabinet when the panel is opened;

a locking device affixed to the panel having a locking member that engages and releasably locks the bolster when the bolster is in a closed position; and a stopper connected to the pivot, the stopper configured to rotate with the bolster and to engage a flange affixed to the panel when the bolster is rotated to a predefined angle.

38. The gaming device of claim 37, which includes a spring which biases the bolster towards the predefined angle.

39. A door pivotally connected to a gaming device cabinet comprising:

a panel;

a bolster connected to the panel by a pivot such that the bolster is able to clear another bolster mounted to another gaming machine adjacent to the cabinet when the panel is opened;

a locking device affixed to the panel having a locking member operable to engage and releasably lock the bolster when the bolster is in a closed position; and a collar connected to the pivot, the collar configured to rotate with the bolster and having a detent positioned to engage a socket when the bolster is rotated to a predefined angle.

40. The gaming device of claim 39, which includes a spring which biases the bolster towards the predefined angle.

41. The gaming device of claim 39, which includes a spring which biases the bolster to a preliminary angle such that the bolster can thereafter be manually rotated from the preliminary angle to the predefined angle.

42. The gaming device of claim 39, which includes a stopper mounted to the collar, the stopper configured to rotate with the bolster and to engage a-flange affixed to the panel when the bolster is rotated to a maximum angle.

43. A gaming device comprising:

a cabinet having first and second sides;

a door pivotally connected to the cabinet so as to have an opening edge that swings away from a first side of the cabinet;

a bolster connected to the door by a pivot located proximate to an end of the bolster, the end positioned proximate to the first side of the cabinet when the door is closed such that the bolster is able to clear another bolster mounted to another gaming machine adjacent to the second side of the cabinet when the door is opened; and a locking mechanism affixed to the door having a pin that protrudes from the door to engage an orifice defined by the bolster and to secure the bolster in a locked position, wherein the pin is attached to a cable which extends adjacent to the opening edge of the door so that the cable can be pulled to disengage the pin from the orifice.

44. The gaming device of claim 43, which includes a spring which biases the pin outwardly from the door into the orifice defined by the bolster.

45. A gaming device comprising:

a cabinet having first and second sides;

a door pivotally connected to the cabinet so as to have an opening edge that swings away from the first side of the cabinet;

a bolster connected to the door by a pivot located proximate to an end of the bolster, the end positioned proximate to the first side of the cabinet when the door is closed such that the bolster is able to clear another bolster mounted to another gaming machine adjacent to the second side of the cabinet when the door is opened; and a locking mechanism affixed to the door having a pin that protrudes from the door to engage an orifice defined by the bolster and to secure the bolster in a locked position, wherein the pin is attached to one end of a cable and a knob is attached to an opposite end of the cable, wherein the knob is positioned adjacent to the opening edge of the door so that the knob can be pulled to disengage the pin from the orifice.

46. A gaming device comprising:

a cabinet having first and second sides;

a door pivotally connected to the cabinet so as to have an opening edge that swings away from the first side of the cabinet;

a bolster connected to the door by a pivot located proximate to an end of the bolster, the end positioned proximate to the first side of the cabinet when the door is closed such that the bolster is able to clear another bolster mounted to another gaming machine adjacent to the second side of the cabinet when the door is opened; and a catch affixed to the door so as to be in a horizontal alignment with a member protruding inwardly from the bolster, the catch providing support for weight placed on the bolster.

47. A gaming device comprising:

a cabinet having first and second sides;

a door pivotally connected to the cabinet so as to have an opening edge that swings away from the first side of the cabinet;

a bolster connected to the door by a pivot such that the bolster is able to clear another bolster mounted to another gaming machine adjacent to a second side of the cabinet when the door is opened; and a stopper connected to the pivot, wherein the stopper is configured to rotate with the bolster and to engage a flange affixed to the door when the bolster is rotated to a predefined angle.

48. The gaming device of claim 47, which includes a spring which biases the bolster towards the predefined angle.

49. A gaming device comprising:

a cabinet having first and second sides;

a door pivotally connected to the cabinet so as to have an opening edge that swings away from the first side of the cabinet;

a bolster connected to the door by a pivot located proximate to an end of the bolster, the end positioned proximate to the first side of the cabinet when the door is closed such that the bolster is able to clear another bolster mounted to another gaming machine adjacent to the second side of the cabinet when the door is opened; and a collar connected to the pivot, wherein the collar is configured to rotate with the bolster and having a detent positioned to engage a socket when the bolster is rotated to a predefined angle.

50. The gaming device of claim 49, which includes a spring which biases the bolster towards the predefined angle.

51. The gaming device of claim 49, which includes a spring which biases the bolster to a preliminary angle so that the bolster can thereafter be manually rotated from the preliminary angle to the predefined angle.

* * * * *

UNITED STATES PATENT AND TRADEMARK OFFICE

CERTIFICATE OF CORRECTION

PATENT NO. : 6,702,409 B2
DATED : March 9, 2004
INVENTOR(S) : Hedrick et al.

It is certified that error appears in the above-identified patent and that said Letters Patent is hereby corrected as shown below:

Title page,
Item [57], ABSTRACT, change "The present invention provides a gaming" to -- A gaming --

Signed and Sealed this

Eighteenth Day of May, 2004

JON W. DUDAS
*Acting Director of the United States Patent and Trademark Office*